US007246418B2

(12) United States Patent
Falk et al.

(10) Patent No.: US 7,246,418 B2
(45) Date of Patent: Jul. 24, 2007

(54) FELTING NEEDLE

(75) Inventors: Frank Falk, Albstadt (DE); Jürgen Weith, Burladingen (DE)

(73) Assignee: Groz-Beckert, KG, Albstadt (DE)

( * ) Notice: Subject to any disclaimer, the term of this patent is extended or adjusted under 35 U.S.C. 154(b) by 0 days.

(21) Appl. No.: 11/645,703

(22) Filed: Dec. 27, 2006

(65) Prior Publication Data

US 2007/0143975 A1 Jun. 28, 2007

(30) Foreign Application Priority Data

Dec. 27, 2005 (EP) ..... 05028503

(51) Int. Cl.
*D04H 18/00* (2006.01)

(52) U.S. Cl. ..... 28/115

(58) Field of Classification Search ..... 28/115, 28/107, 112–114, 108–110, 162; 112/222, 112/223, 224; 223/102, 103, 104; 289/16; 26/29 R, 30, 31, 36; 163/1, 5; 606/222, 606/223

See application file for complete search history.

(56) References Cited

U.S. PATENT DOCUMENTS 461,602 A 10/1891 Boult
1,073,140 A * 9/1913 Kendig ..... 112/224
2,873,507 A * 2/1959 Kelson ..... 28/115
3,353,243 A * 11/1967 Foster ..... 28/115
3,479,708 A * 11/1969 Foster ..... 28/115
3,566,663 A * 3/1971 Zoher ..... 28/115
3,645,222 A * 2/1972 Zocher ..... 112/224
3,753,412 A * 8/1973 Shepard et al. ..... 112/222
3,976,525 A * 8/1976 Mednick ..... 28/115
6,233,797 B1 * 5/2001 Neely et al. ..... 28/115
7,114,226 B2 * 10/2006 Wizemann ..... 28/115

FOREIGN PATENT DOCUMENTS

DD 243 055 A1 2/1987
DE 2 101 769 7/1972
JP 05-214659 8/1993

* cited by examiner

*Primary Examiner*—Amy B. Vanatta
(74) *Attorney, Agent, or Firm*—Norman N. Kunitz; Fitch, Even, Tabin & Flannery

(57) ABSTRACT

The felting needle according to the invention comprises a working part (12) with two partial sections (15, 16), each of which is preferably embodied with straight edges. The two partial sections are twisted slightly, relative to each other. Each partial section is provided with at least one ring of indentations with the indentations arranged offset to each other in axial direction. As a result, all notches are oriented uniformly in the direction of the longitudinal axis (14), despite the slight twisting of the section between the two partial sections (15, 16). The felting needle can thus be used to produce fleece materials and needle-punched felt materials, which have a nearly uniform tearing resistance in longitudinal as well as lateral direction.

16 Claims, 2 Drawing Sheets

FELTING NEEDLE

CROSS REFERENCE TO RELATED APPLICATION

This application claims the priority of European Patent Application No. 05 028 503.0, filed on Dec. 27, 2005, the subject matter of which, in its entirety, is incorporated herein by reference.

BACKGROUND OF THE INVENTION

The invention relates to a felting needle.

Felting needles are used for the production of felt and fleece materials and punched in quickly repeated sequence through the fleece material to strengthen the fleece of tangled fibers. As a result, the fibers in the fleece are intertwined and the fleece is further compacted.

In principle, felting needles suitable for this purpose are known from document DE 21 01 769 A1. This document discloses felting needles comprising a straight working part as well as a screw-type working part. The working part extends along a straight center axis and has a triangular or square cross section. The edges of the working parts are provided with indentations.

In the non-compacted state, the fiber fleece to be compacted with the felting needles can consist, for example, of several layers of fibrous web in which the fibers are respectively arranged in one preferred direction. If a fibrous web of this type is compacted, for example, with the straight felting needles according to document DE 21 01 769 A1, different tearing or breaking resistances result for the most part in longitudinal and lateral direction, which is undesirable. On the other hand, if felting needles with twisted operating parts are used, such as the ones known from document DE 21 01 769 A1, the twisting of the operating parts results in larger punching holes and a lower efficiency of the needle-felting process.

As is known from U.S. Pat. No. 461,602, attempts have been made, using felting needles with straight as well as twisted working parts, to increase the needle-felting efficiency by providing each edge with indentations facing in opposite directions. This measure, however, fundamentally changes the sequence of the needle-felting process and thus for the most part has an undesirable influence on the appearance of the needle-felted product.

Starting from this, it is the object of the present invention to create a felting needle, which makes it possible to produce with high efficiency fleece and felt materials, for which the differences in the tearing resistances in the various surface directions are reduced.

SUMMARY OF THE INVENTION

The above object generally is achieved according to the invention with the felting needle as defined in claim 1:

The felting needle according to the invention has a working part provided with indentations and divided into at least two partial sections. Both partial sections have edges provided with indentations, wherein the edges are essentially oriented parallel to the longitudinal direction of the working part, at least in the regions with indentations. As a result of this measure, the indentations are oriented in punching-in direction (or also counter thereto), as is the case for non-twisted felting needles, thus allowing them to pick up the highest possible number of fibers during the punching in, thus effectively contributing to the needle-felting process.

Between these partial sections, the working part is twisted or turned around its longitudinal axis. The indentations provided along the same edge therefore are not aligned and pick up different fiber groups during the punching in, thereby considerably increasing the needle-felting efficiency.

The two partial sections are preferably each designed straight and non-twisted. The twisted or turned section of the working part is therefore restricted to a short, twisted section. For that reason, the tendency to direct fibers around the punching-in hole and to enlarge this hole, which is normally found with working parts that are twisted over the complete length, cannot be observed in this case. Rather, the needle-felting in this case is effective in all directions across the area, thereby resulting in a fleece with high longitudinal and lateral tear resistance. In particular, it is possible to observe an approaching of the values measured for the lateral and longitudinal tearing resistance.

The felting needle according to the invention is particularly suitable for producing fleece or felt material from a multilayer web with directional layers, but can also be used for needle-felting tangled fiber layers without a pronounced orientation. Fiber layers of this type are frequently referred to as "fibrous web."

According to one preferred embodiment, each partial section of the working part is provided with at least one ring of indentations and, in the preferred case, precisely one ring of indentations. In that case, each edge of the partial section of the working part is provided with precisely one indentation. For triangular cross sections, three indentations are thus created on the partial section. These indentations are positioned at the same height or, as is preferable, arranged axially offset to each other. The axial offset of two indentations on neighboring edges preferably amounts to approximately 3 mm to 4 mm, preferably 3.18 mm. In that case, the indentations are preferably arranged along a screw line, but different arrangements are possible as well.

The two partial sections of the working part are preferably spaced apart at a longer distance, wherein each partial section is preferably provided with a ring of indentations and wherein the two sections are separated by the twisted section. In the preferred case, this distance is 6 mm to 7 mm, preferably 6.35 mm. The two indentations in a row, meaning those indentations in the rings of indentations on the partial sections, which come closest to each other, are preferably embodied on different edges of the working part. This increases the needle-felting efficiency and equalizes the transverse and longitudinal tearing resistance of the fleece material that is produced.

The rings of indentations on the two partial sections can be located on the same or different screw lines. The screw lines can have different pitches, different winding directions, or also the same pitches, which is preferred.

The felting needle according to the invention in the twisted section is preferably twisted around the longitudinal axis by an angle that is equal to 360° divided by the product of the number of partial sections and the number of edges of each partial section. In the case of the triangular cross section and a felting needle with two partial sections, the twisting angle is 60° (360°/(2×3)=60°. For a felting needle with three partial sections and triangular cross section, this formula results in a twisting angle of 40°. For a square cross section and a working part with two partial sections this results in a twisting angle of 45°. The edges of the partial sections are therefore "arranged with a gap" which is preferred because of the achievable good needle-felting efficiency.

Further details of advantageous embodiments of the invention follow from the drawing, the specification and/or the claims.

BRIEF DESCRIPTION OF THE DRAWINGS

The drawing illustrates the exemplary embodiments of the felting needle according to the invention and a system for producing felt materials, wherein.

DETAILED DESCRIPTION OF THE INVENTION

Figure 1:
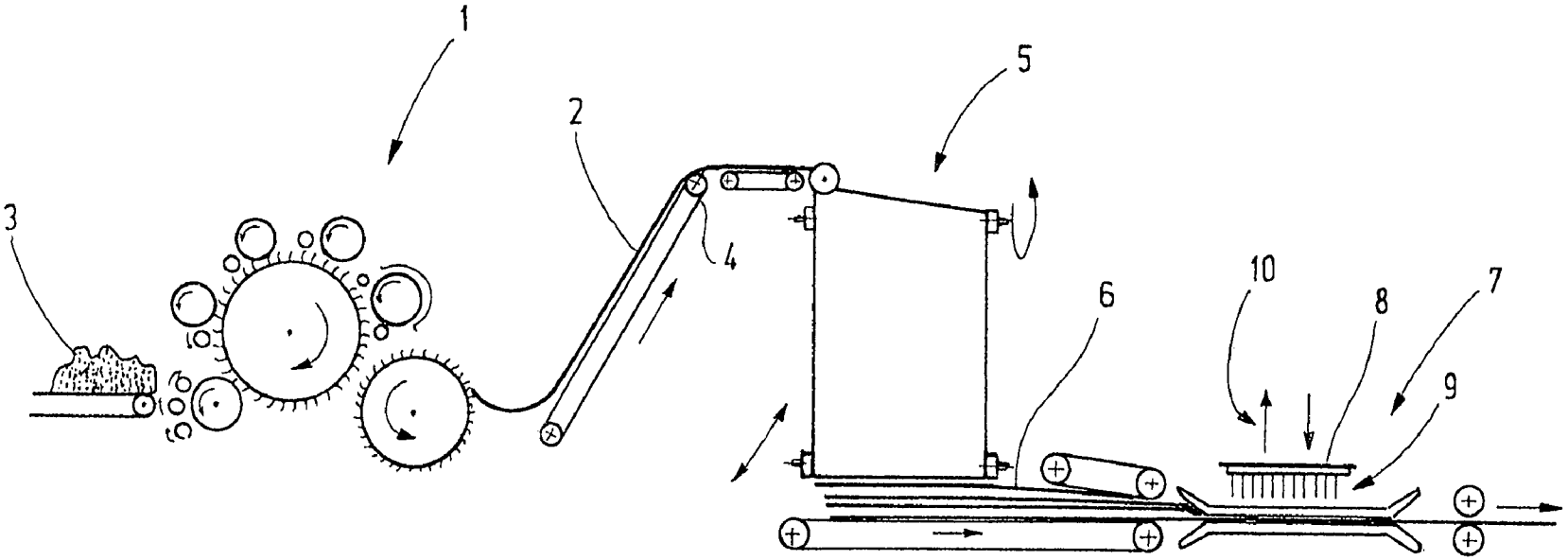
FIG. 1 is a schematic representation of a system for producing felt materials.

FIG. 1 shows a system for producing needle-punched felt or fleece materials from fibrous webs. The system includes a so-called card 1 with several rollers for generating a fibrous web 2, having directional layers in longitudinal direction, by accordingly processing the fiber flakes 3. The card 1 functions to mechanically arrange parallel, clean, and refine the fibers of the fiber flakes and to arrange these into a fibrous web. This web is transferred to a transport belt 4 which conveys the fibrous web to a cross-stacker or a transverse stacker 5. The cross stacker 5 generates a stack 6, consisting of several layers, wherein the superimposed layers have different orientations. The stack 6 it supplied to a needle-felting machine 7, which comprises a needle board 8 with felting needles 9. These are moves synchronously up and down, as indicated with arrow 10, and thus repeatedly punch into the stack to compact it into a felt or fleece material.

Figure 2:
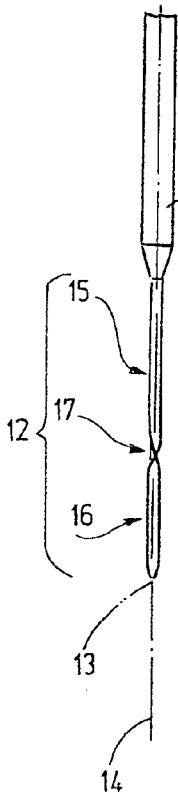
FIG. 2 is a sectional view from the side of the felting needle according to the invention.

The special feature of this system lies in the embodiment of the felting needle 9. A felting needle 9 of this type is shown as example in FIG. 2. The felting needle 9 has a fastening section that is not shown further in the above, with a cylindrical shank 11 extending outward from it. The shank 11 transitions into a working part 12 which is arranged straight and concentric to a longitudinal axis 14 extending through its tip 13. The shank 11 is preferably arranged concentric to the longitudinal axis 14.

The working part 12 represents the section of the felting needle 9 that is used for the needle-felting of tangled fibers. It consists of at least two partial sections 15, 16 which are joined by means of a twisted section 17 (twisted region). While the tip 13 is embodied on the partial section 16, the partial section 15 adjoins the shank 11 and preferably has a smaller cross section than the shank.

Figure 3:
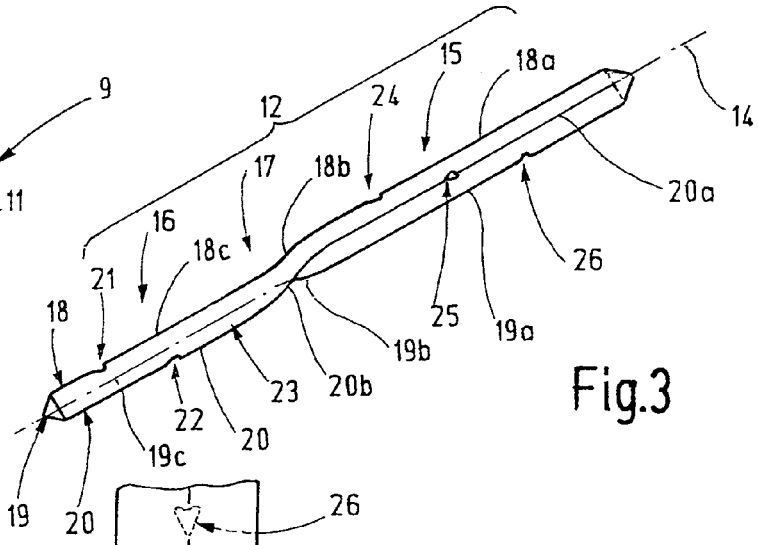
FIG. 3 is a sectional, perspective view of the felting needle according to the invention of FIG. 2.

FIG. 3 contains a perspective illustration of the partial sections 15, 16 and the section 17, arranged in-between. As can be seen, both partial sections 15, 16 have identical cross sections which are triangular for the exemplary embodiment, wherein the cross sections can also be different, for example in the form of two, four, or multiple cross sections, star-shaped cross sections and the like.

The working part 12 for the exemplary embodiment according to FIG. 3 has three continuous edges 18, 19, 20. The edge 18 extends as edge 18*a* along the partial section 15, as edge 18*b* along the region 17, and as edge 18*c* along the partial section 16. Correspondingly, the edges 19 and 20 extend as edges 19*a* to 19*c* and 20*a* to 20*c* over the length of the working part 12. The edges 18*a*, 19*a*, 20*a* are preferably embodied straight and arranged parallel to the longitudinal axis 14. In the same way, the edges 18*c*, 19*c*, 20*c* are preferably embodied straight and arranged parallel to the center axis 14. The edges 18*b*, 19*b*, 20*b* follow respective screw lines, in the present case those of a left-hand threaded bolt. To illustrate the resulting twisting, we refer to FIG. 5, wherein the illustration of the twisted region was omitted in FIG. 5. As can be seen, the edges 18*a*, 18*b*, 19*a*, 19*c*, 20*a*, 20*c* are arranged respectively in pairs and offset. The twisting angle is computed as the quotient from 360° and the product of the number of partial sections 15, 16 (which in this case is two) and the number of edges 18, 19, 20 (in this case three). The angle of rotation is thus 60° and the edges 18*c*, 19*c*, 20*c* are positioned exactly in the center between the distances between edges 18*a* and 19*a*, 18*a* and 20*a*, and 19*a*, 20*a*.

Figure 4:
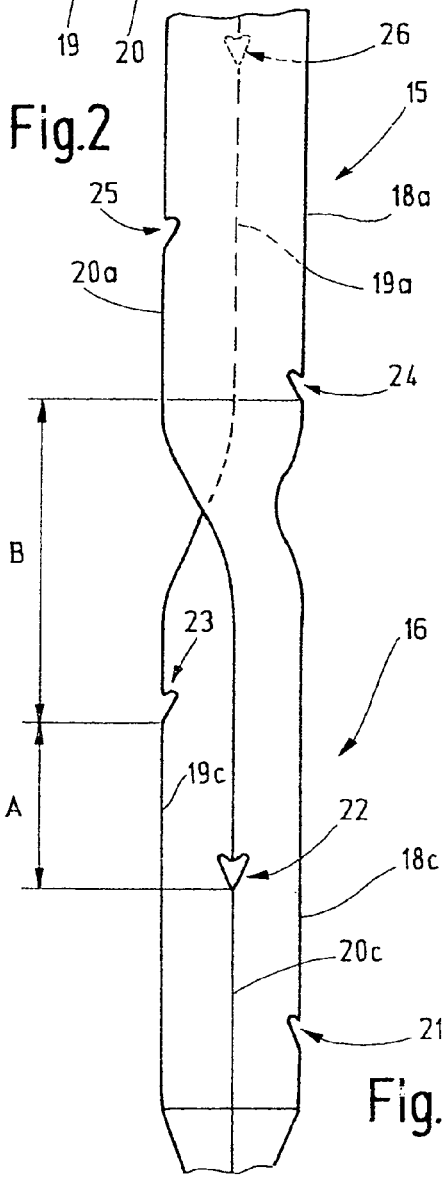
FIG. 4 is a an enlarged view from the side of a modified embodiment of the felting needle according to the invention.

At least one ring of indentations with three indentations 21, 22, 23 is provided on the partial section 16 of working part 12. In addition, at least one ring of indentations with three indentations 24, 25, 26 is provided on the partial section 15. Thus, at least one indentation is assigned to each edge 18*a*, 19*a*, 20*a* and/or 18*c*, 19*c*, 20*c* in each partial section 15, 16. The indentations are preferably oriented in punching in direction, meaning toward the tip 13. Alternatively or additionally, indentations oriented in opposite directions can also be provided, but are not shown herein. The indentations 21 to 26 are located along the edges 18*a*, 19*a*, 20*a* and/or 18*c*, 19*c*, 20*c*, which are oriented parallel to the longitudinal axis 14. The parallelism of the edges 18*a*, 19*a*, 20*a* and 18*c*, 19*c*, 20*c* extends at least over the region comprising the indentations 21 to 26. The indentations 21 to 26 are preferably also oriented parallel to the longitudinal axis 14. At each partial section 15, 16, the respective indentations 24, 25, 26 and/or 21, 22, 23 are positioned axially offset, so that they are located along a screw line. According to the embodiment shown in FIG. 3, the screw line on the partial section 15 always has the same pitch and winding direction. In this case, the winding direction is always counter to the winding direction of region 17. However, it can also be in the same winding direction, as shown with exemplary embodiment in FIG. 4. The exemplary embodiments according to FIGS. 3 and 4 insofar differ only by the winding direction of the screw lines determined by the ring of indentations. Otherwise, the description for the felting needle 9 according to FIG. 3 also applies correspondingly to the embodiment according to FIG. 4 and vice versa.

The indentations 21, 22, 23 and/or 24, 25, 26 of each ring of indentations are preferably arranged at a distance A, which ranges from 3 mm to 4 mm, but is preferably 3.18 mm. The distance measured in this case is the distance between the beginning of the indentations or, alternatively, any other reference point determined for the indentations. The indentations 23, 24 of both partial sections 15, 16 that are closest to each other relative to the longitudinal direction are arranged at a distance B, which preferably is noticeably longer than the length of the region 17 and also longer than the distance A. Preferably, the distance B is twice the length of the distance A and, in the preferred case, amounts to 6.36 mm.

Figure 5:
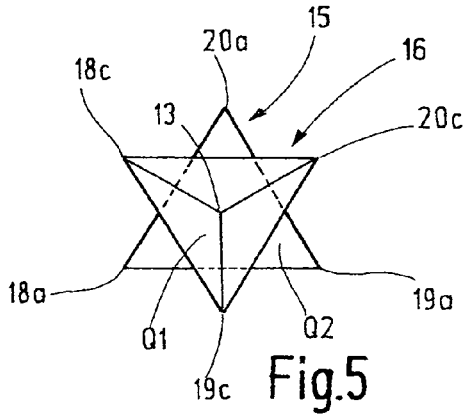
FIG. 5 is a frontal view of a felting needle according to the invention with a triangular cross section; and, FIG. 6 is a frontal view of a different, modified embodiment of the felting needle according to the invention with a square cross section.

As a result of the twisting or turning of the working part 12 in the region 17, as shown in particular in FIG. 5, a felting needle is obtained which functions in the manner of a hexagonal needle, even though it has only three edges. During the needle-felting of a fleece material, more fibers are therefore picked up from several directions, meaning also as a result of the orientation of preferably all indentations in the direction 14. This positively influences the adaptation of the tearing forces exerted by various stress directions of the fleece material. In addition, the size of the punched hole and damage to the fibers is minimized. A fitting of the fibers around a punching hole, as can happen with the working parts, does not occur.

Figure 6:
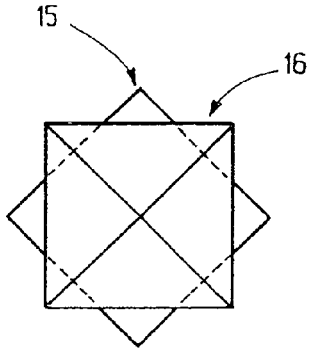

As mentioned before, the felting needle 9 has a different working part cross section, as illustrated in FIG. 6 with the aid of a square working part cross section. The twisting of the partial sections 15, 16 relative to each other in this case is 45° (360°: (2×4)=45°; for two partial sections and four edges). The effect of an eight-edge felting needle is achieved, wherein the needle-felting efficiency is especially high, as for the previous example, because of the longitudinal orientation of the edge provided with the indentations.

The following operational steps are taken for producing a fleece material:

With the system illustrated in FIG. 1, a stack consisting of various batches and straightened fiber layers is slowly moved from left to right under the needle board 8, shown in FIG. 1. In the process, the felting needles 9 of the needle board 8 punch in a rapid sequence through the stack. The felting needles 9 penetrate the stack with their respective tips 13, wherein initially the indentations 21, 22, 23 pick up fibers and then pull these downward. During the further course, the twisted region 17 then punches through the material and is followed by the straight partial section 15 with indentations 24, 25, 26. These indentations are offset against the indentations of the previous ring of indentations and thus pick up other fibers which are again pulled into the punching hole for the felting. During the return stroke, the partial section 15 initially glides through the punched hole, which is then deformed during the passage of the twisted section 17, whereupon the straight partial section 16 slides out. As a result of the passage of the twisted section 17, the threads pulled into the hole are worked into the remaining fiber body, which reinforces the strength of the fleece material.

The partial sections 15, 16 preferably have identical cross sections Q1, Q2 and consequently also have respectively the same number of edges 18*a*, 19*a*, 20*a* and/or 18*c*, 19*c*, 20*c*.

The felting needle 9 according to the invention has a working part 12 with two partial sections 15, 16, wherein each section is preferably embodied with straight edges. The two partial sections are twisted slightly, relative to each other. Each partial section is provided with at least one ring of indentations with indentations that are arranged axially offset relative to each other. As a result, all indentations are advantageously oriented uniformly in the direction of longitudinal axis 14, despite the slight twisting between the two partial sections 15, 16. With this felting needle, fleece materials and needle-punched felts can be produced, which have a nearly uniform tearing resistance in longitudinal as well as lateral direction.

It will be appreciated that the above description of the present invention is susceptible to various modifications, changes and adaptations, and the same are intended to be comprehended within the meaning and range of equivalents of the appended claims.

| List of Reference Numbers: | |
|---|---|
| 1 | card |
| 2 | directional layers - fibrous web |
| 3 | fiber flakes |
| 4 | transport belt |
| 5 | cross stacker; lateral stacker |
| 6 | stack, fibrous web |
| 7 | felting machine |
| 8 | needle board |
| 9 | felting needles |
| 10 | arrows |
| 11 | shanks |
| 12 | working part |
| 13 | tip |
| 14 | longitudinal axis |
| 15, 16 | partial sections |
| 17 | region (twisted and/or turned) |
| 18, 18a, 18b, 18c | edges |
| 19, 19a, 19b, 19c | edges |
| 20, 20a, 20b, 20c | edges |
| 21, 22, 23, 24, 25, 26 | indentations |
| A | distance |
| B | distance |
| Q1, Q2 | cross section |

The invention claimed is:

1. A felting needle (9), with a longitudinal shank (11) that defines a longitudinal direction (14), on which a working part (12) is embodied, which has a two-cornered or multi-cornered cross section (Q1, Q2), wherein the working part (12) is provided with indentations (21-26) and is divided into at least two partial sections (15, 16), for which the edges (18*a*, 19*a*, 20*a*; 18*c*, 19*c*, 20*c*) at least in the region of their indentations (21-26) are arranged substantially parallel to the longitudinal direction (14) and which have cross sections (Q1, Q2) that are turned relative to each other.

2. The felting needle according to claim 1, characterized in that the edges (18*a*, 19*a*, 20*a*; 18*c*, 19*c*, 20*c*) are arranged along a straight line.

3. The felting needle according to claim 1, characterized in that a twisted section (17) is embodied between the partial sections (15, 16) and this twisted section has edges (18*b*, 19*b*, 20*b*) that extend in a screw line around the longitudinal direction (14).

4. The felting needle according to claim 3, characterized in that the twisted section (17) is embodied without indentations.

5. The felting needle according to claim 1, characterized in that the indentations (21-26) are arranged along the edges (18*a*, 19*a*, 20*a*; 18*c*, 19*c*, 20*c*), which are arranged parallel to the longitudinal direction.

6. The felting needle according to claim 1, characterized in that the indentations (21-26) follow a screw line.

7. The felting needle according to claim 6, characterized in that the indentations (21-23) of the one partial section (16) are positioned on the same screw line as the indentations (24-26) of the other partial section (15).

8. The felting needle according to claim 1, characterized in that the indentations (21-23) of the one partial section (16) are positioned on a different screw line than the indentations (24-26) of the other partial section (15).

9. The felting needle according to claim 8, characterized in that the screw lines are pitched in opposing directions.

10. The felting needle according to claim 1, characterized in that the indentations (21-26) of a partial section (16, 15)

are spaced apart at a distance (A) between indentations, which is respectively measured along each edge (18*a*, 19*a*, 20*a*; 18*c*, 19*c*, 20*c*) and is considerably shorter than the indentation spacing (B) measured across the twisted section (17) along one edge (18, 19, 20).

11. The felting needle according to claim 10, characterized in that the indentation spacing (A) within one partial section (15, 16) is essentially half the size of the indentation spacing (B) between the two partial sections (15, 16).

12. The felting needle according to claim 10, characterized in that the indentation spacing (A) in the partial sections (15, 16) ranges from 3 mm to 4 mm.

13. The felting needle according to claim 10, characterized in that the indentation spacing (B) between the partial sections (15, 16) ranges from 6 mm to 8 mm.

14. The felting needle according to claim 1, characterized in that the working part (12) has a triangular cross section (Q1, Q2).

15. The felting needle according to claim 1, characterized in that the twisting angle of the partial sections (15, 16) relative to each other is equal to 360°, divided by the number of partial sections (15, 16), in turn divided by the number of edges (18, 19, 20) of the working part (12).

16. The felting needle according to claim 1, characterized in that the indentations (21-26) are oriented in longitudinal direction (14).

* * * * *